US008887807B2

(12) United States Patent
Gambier et al.

(10) Patent No.: US 8,887,807 B2
(45) Date of Patent: Nov. 18, 2014

(54) APPARATUS AND METHODS FOR DEPLOYING CEMENTING PLUGS

(75) Inventors: Philippe Gambier, Boa Vista (AO); Laurent Coquilleau, Houston, TX (US); James Metson, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 830 days.

(21) Appl. No.: 13/130,182

(22) PCT Filed: Nov. 24, 2009 (Under 37 CFR 1.47)

(86) PCT No.: PCT/EP2009/008427
§ 371 (c)(1), (2), (4) Date: Jul. 11, 2012

(87) PCT Pub. No.: WO2010/063406
PCT Pub. Date: Jun. 10, 2010

(65) Prior Publication Data

US 2013/0014948 A1 Jan. 17, 2013

(30) Foreign Application Priority Data

Dec. 4, 2008 (EP) ..... 08170646

(51) Int. Cl.
*E21B 33/16* (2006.01)

(52) U.S. Cl.
CPC ..... *E21B 33/16* (2013.01)
USPC ..... 166/291; 166/153

(58) Field of Classification Search
CPC ..... E21B 33/16; E21B 33/136
USPC ..... 166/291, 153, 177.4
See application file for complete search history.

(56) References Cited

U.S. PATENT DOCUMENTS

| | | | | |
|---|---|---|---|---|
| 5,787,979 | A | 8/1998 | Giroux et al. | |
| 7,182,135 | B2 * | 2/2007 | Szarka | 166/265 |
| 7,845,400 | B2 * | 12/2010 | Smith et al. | 166/177.3 |
| 2005/0103492 | A1 | 5/2005 | Wustenberg | |

FOREIGN PATENT DOCUMENTS

| | | |
|---|---|---|
| WO | WO99/14461 | 3/1999 |
| WO | WO99/19601 | 4/1999 |

* cited by examiner

*Primary Examiner* — William P Neuder
(74) *Attorney, Agent, or Firm* — Michael Dae

(57) ABSTRACT

An apparatus for installing cement plugs into a well, comprising a protective sleeve having one end adapted to be attached to the end of a drill pipe and arranged to carry a cementing plug around its outer surface such that a dart passing through the drill pipe can pass through the sleeve and engage only on formations on the plug to withdraw it from the end of the sleeve.

20 Claims, 7 Drawing Sheets

APPARATUS AND METHODS FOR DEPLOYING CEMENTING PLUGS

TECHNICAL FIELD

This invention relates to apparatus and methods for use in cementing operations in wells such as oil and gas wells. In particular, the invention relates to apparatus as methods for deploying cementing plugs used such operations.

BACKGROUND ART

In conventional well drilling operations such as those used for drilling oil and gas wells, the drilling fluid, sometime called 'drilling mud', is circulated down the well through the tubular drill pipe used to carry the bit and back to the surface to carry debris away from the drill bit. The hydrostatic pressure of the drilling fluid column also provides mechanical and physical support to the borehole wall and prevents fluid mixing between subterranean layers in the formation by providing a pressure balance.

However, as the depth of the borehole increases, the hydrostatic pressure imposed by the drilling fluid column at the bottom of the borehole increases and may surpass the fracture pressure of the formation which can lead to damage while decreasing the density of the drilling fluid to avoid this may in turn mean that it is no longer possible to provide pressure balance at shallower depths in the borehole.

In order to overcome this problem, or to finish construction of the well once the target depth has been reached, it is common to support the borehole walls by cementing a tubular liner, called a 'casing', into the well.

During a casing operation, a continuous casing, formed by a number of tubular sections joined end to end, is lowered into the well and cement is pumped down the inside of the casing to exit at its lower end and fill the annulus formed between the outside of the casing and the borehole wall where it is allowed to set.

Once this process has been completed, drilling can be restarted in the usual way and the cement casing provides the physical and mechanical support for the top part of the formation that was previously drilled.

Since it is necessary to maintain the borehole full of fluid during any operation, it can be necessary to prevent successive fluids from mixing as they are pumped into the well if their function is not to be compromised. For example, it may be necessary to pump cement into a well filled with drilling fluid which, if mixed with the cement, may affect its setting behaviour. Alternatively, wash fluids may precede the cement in order to remove accumulated deposits or gelled drilling fluid to improve cement performance.

One approach to dealing with this problem is to pump plugs ahead of and behind the cement to separate it from the other fluids in the borehole.

FIGS. 1 and 2 show an example of a known apparatus for deploying such cement plugs.

The apparatus comprises a tubular basket 20 that is located at one end at the end of a drill pipe 12 that is used for delivery of cement and is open at the other end. The outer diameter of basket 20 is larger than the drill pipe and houses cementing plugs 18, 22. As can be seen, each plug has an opening at its lower end that is smaller than the inner diameter of the drill pipe 12. The opening of the lower plug 22 is in turn smaller than the corresponding opening in the plug above 18.

The openings in the cement plugs 18, 22 allow for fluid flow therethrough. However, the limited size of the openings is a limiting factor for pumping fluids at a high flow rate.

Additionally there is a risk of eroding the inner diameter of the cement plugs when pumping the solids laden fluids through the plugs.

Deployment of the plugs 18, 22 is achieved by pumping darts 10, 14 from the surface through the drill pipe 12. The darts 10, 14 seat in the openings of the plugs 18, 22 so as to block fluid flow and the pressure caused by this blockage causes the plug to be driven from the basket 20 (see FIG. 2). The bottom dart 14 has a smaller profile than that of upper dart 10 in order to be able to pass through opening in the upper cement plug 18 to seat in the opening of the lower plug 22. As a result, it is vital that the cement plugs are loaded into the basket 20 in the correct order and that the darts 10, 14 are launched down the drill pipe 12 in the correct order so that the correct cement plug is injected into the well.

The number of cement plugs that can be loaded into the basket is limited due to the need for a constantly decreasing inner diameter of the opening in each consecutive cement plug. In the current state of the art, two cement plugs per basket is the limit.

It is therefore the object of this invention to provide a new apparatus for injecting cement plugs into a well which protects the inner diameter of the cement plugs from being eroded by fluid being pumped through them, allows for more than two cement plugs to be stored and injected into the well in one trip.

Disclosure of the Invention

A first aspect of this invention provides an apparatus for installing cement plugs into a well, comprising a protective sleeve having one end adapted to be attached to the end of a drill pipe and arranged to carry a cementing plug around its outer surface such that a dart passing through the drill pipe can pass through the sleeve and engage only on formations on the plug to withdraw it from the end of the sleeve.

The apparatus preferably comprises a tubular basket having one end adapted to be attached to the end of a drill pipe and being open at the other end, the basket defining a receptacle in which a cementing plug can be retained such that a dart passing through the drill pipe can engage on formations on the plug to withdraw it from the basket through the open end;

wherein the apparatus further comprises a protective sleeve extending through the interior of the basket from the end to be attached to the drill pipe so as to define an annular chamber in which the cement plug can be retained such that the dart can pass through the protective sleeve and only engage the plug by means of the formations at the open end.

The basket is typically sized to accommodate more than one cementing plug (two or three being preferred) positioned one above the other, the formations on only the lowermost extending inwards of the sleeve diameter so as to be engageable by a dart.

The protective sleeve can be arranged to rupture as the lowermost cementing plug is withdrawn from the basket so that the formations of the cementing plug immediately above are allowed to project inwardly of the new end of the protective sleeve.

The protective sleeve typically has substantially the same internal diameter as the drill pipe.

A preferred form of the apparatus has at least one cementing plug retained in the basket such that formations on the plug project radially inwardly of the end of the protective sleeve so as to be engageable by a dart. Preferably, more than one cement plug is provided, each of substantially the same size and dimensions.

In one embodiment, each cementing plug is formed with a section of the protective sleeve which detaches from the apparatus as the plug is withdrawn from the basket.

The formations on the cement plug typically comprise a resiliently deformable section that deforms inwardly when not supported in the sleeve. The resiliently deformable section can comprise at least one finger, and can also comprise a shape memory material, or a pivotable member that is biased inwardly by a resilient material such as rubber or a spring.

A second aspect of the invention provides a method of deploying a cementing plug, comprising:

loading a cementing plug into an apparatus according to the first aspect of the invention;

connecting the apparatus to the end of a drill pipe;

positioning the drill pipe in a well;

pumping a dart from the surface through the drill pipe so as to pass through the protective sleeve and engage the formations on the plug and withdraw it from the sleeve.

A preferred embodiment of this method further comprises:

loading more than one cement plugs into the apparatus, one above the other;

pumping a first dart to withdraw the lowermost plug from the basket;

allowing the next successive plug to adopt the lowermost position; and pumping a second dart to withdraw the next plug from the basket.

In one case, the next plug moves to the end of the basket to assume the lowermost position. In another case, withdrawal of a plug from the basket serves to also remove a portion of sleeve around which the plug is located.

The protective sleeve protects the inside diameter of the cement plugs from abrasion and erosion by fluid that is pumped into the well.

The invention permits multiple cement plugs to be used in the apparatus of the same size. Consequently, all darts used in the apparatus can also be the same size and have the same profile.

In one embodiment of the invention, the protective sleeve is formed from sections, with each section being part of an associated cement plug. In this embodiment, each section of protective sleeve extends upwards from the cement plug and engages with the protective sleeve section of the plug above. Preferably a shear section between the sections of protective sleeve allows the lower plug to be detached from the plug above.

In a further embodiment, the cement plugs are held in the basket by a plug lock. This plug lock can be a restriction in the basket section, a gate that is spring loaded, or any other means (such as a diameter restriction) that could be used to prevent the plug from falling out of the basket due to gravity or a In another embodiment, the plug lock can form part of the protective sleeve.

Further aspects of the invention will be apparent from the following description.

MODE(S) FOR CARRYING OUT THE INVENTION

Figure 1:
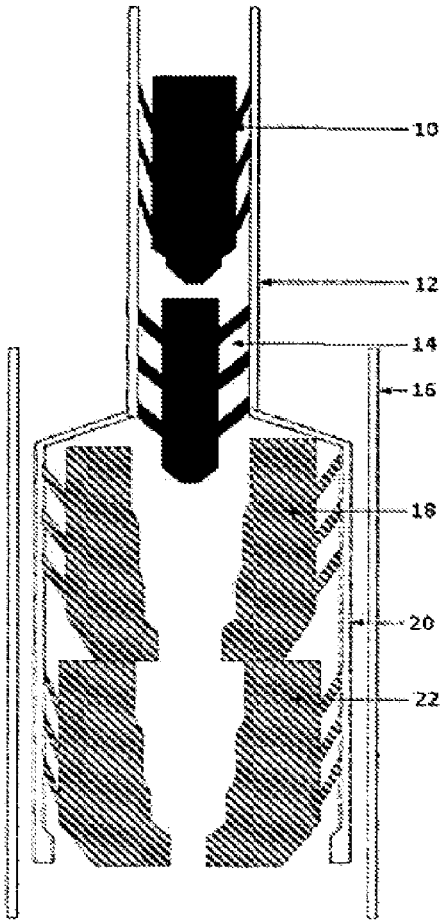
FIGS. 1 and 2 show a prior art apparatus.
Figure 2:
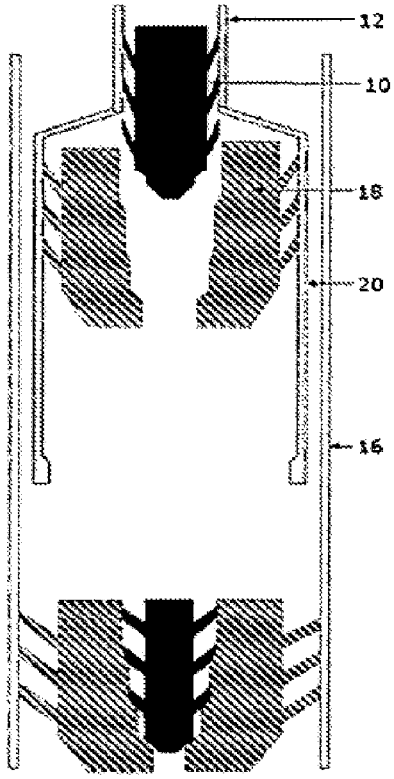
Figure 2 PRIOR ART
Figure 3:
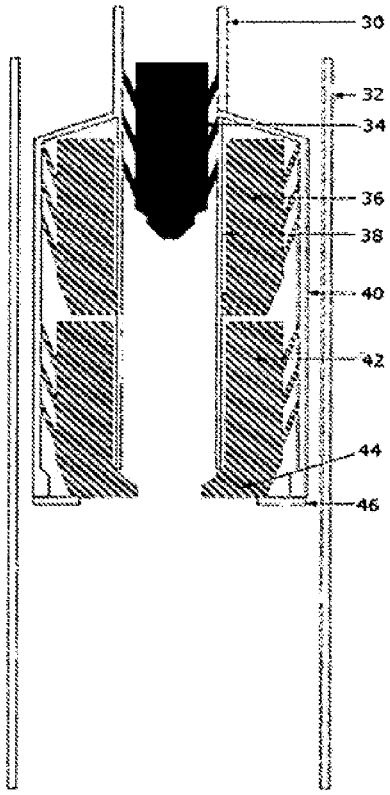
FIG. 3 shows apparatus according to an embodiment of the invention prior to deployment of a first cement plug.
Figure 4:
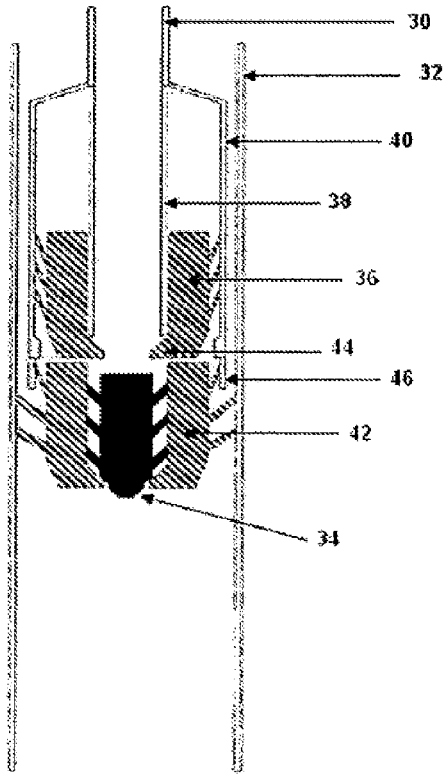
FIG. 4 shows the apparatus of FIG. 3 during deployment of a first cement plug.
Figure 5:
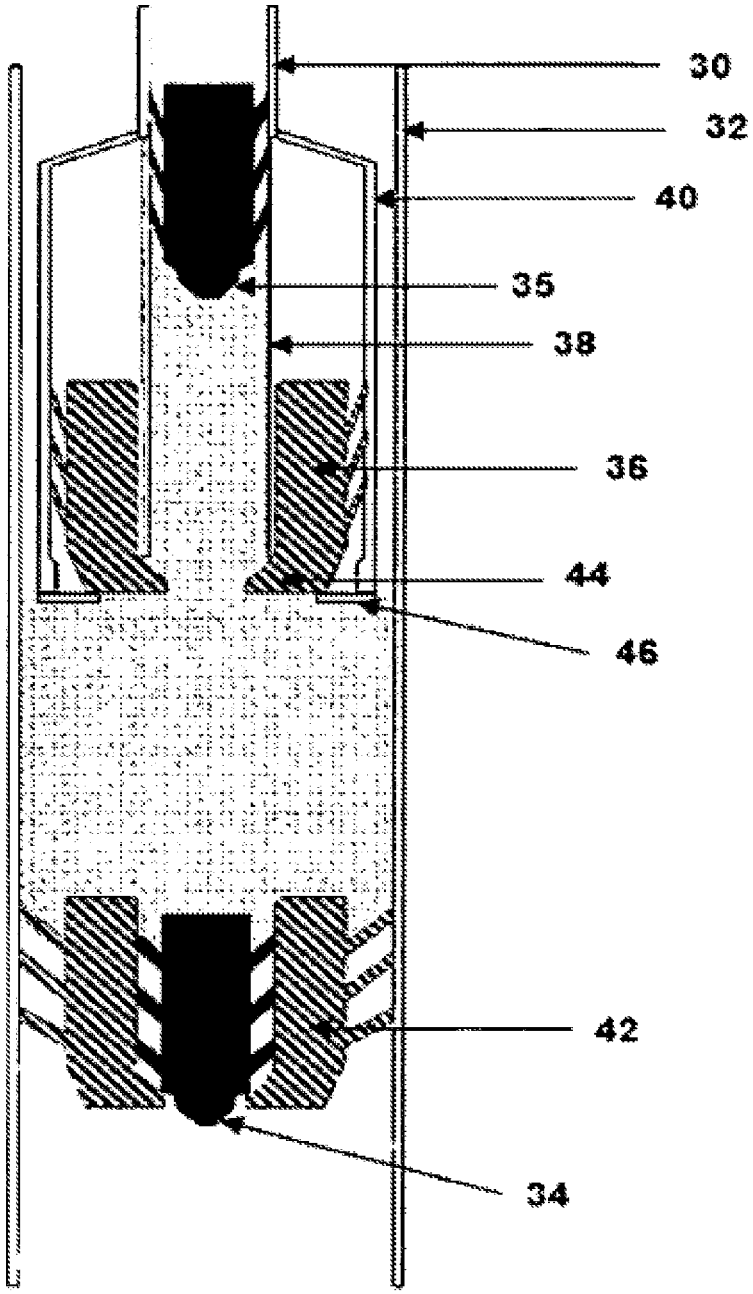
FIG. 5 shows the apparatus of FIG. 4 after deployment of the a cement plug and prior to deployment of a second cement plug.

With reference to FIGS. 3, 4 and 5 the apparatus according to an embodiment of the invention comprises a basket 40 located at the end of a drill pipe 30. A protective sleeve 38 extends though the inside of the basket 40 from the end of the drill pipe 30 to terminate just above the end of the basket. An annulus is created between the inner surface of the basket 40 and the outer surface of the protective sleeve 38 defining a receptacle or chamber in which cement plugs 36, 42 are loaded.

The lower end of each plug 36, 42 comprises a deformable section defining inwardly directed formations 44. The protective sleeve 38 does not extend down level to the end of the basket 40 and so allows the resiliently deformable section 44 of the lowermost cement plug 42 to deform towards the inside of the sleeve 38. This process is shown in greater detail in FIGS. 6*a* and 6*b*.

To deploy the lowermost plug 42, a dart 34 is pumped through the drill pipe 30 in the usual way. The dart passes through the sleeve 38 and engages with the formations 44 to withdraw the dart 42 from the basket 40. The presence of the sleeve 38 means that the upper plug 36 is unaffected at this stage. As is shown in FIG. 4, the dart 34 is caught by the deformable section 44 of the lower cement plug 42 and the pressure applied to it from the surface via the drill pipe 30 forces the lower cement plug and dart out of the basket 40 into the well casing 32. Consequently, there is no specific need to reduce the diameter of the plug over its entire section, and the deformable section may comprise a plurality of fingers, with the minimum being three.

The lower end of the basket 40 is provided with a plug lock 46, which is forced open by the increased pressure, allowing the cement plug to pass out of the basket 40, and when the plug has exited (see FIG. 5) the plug lock 46 returns back to the closed position to stop the next cement plug 36 from exiting the basket at the same time. The cement is between the lower plug/dart 42, 34 and the upper dart 35. As the pumping continues, the second dart 35 passes through the protective sleeve 38 (see FIG. 5) and engage with the upper plug 36 in the same manner as described above. An advantage of this approach is that the second, and indeed all consecutive darts, can be of the same size and proportions as the first dart due to the ability to have identical cement plugs stored in the basket. The sleeve 38 acts to hold the plugs open so that there is no restriction of the flow diameter by plugs stored in the basket 40.

Figure 6A:
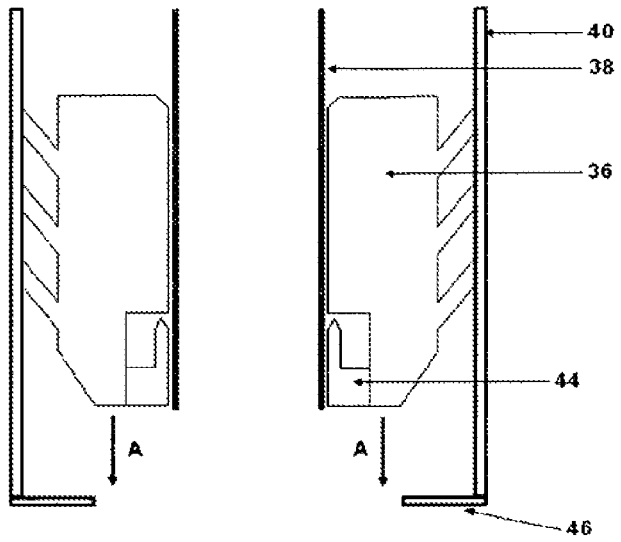
FIGS. 6*a* and 6*b* show the operation of a deformable section of a cement plug.
Figure 6B:
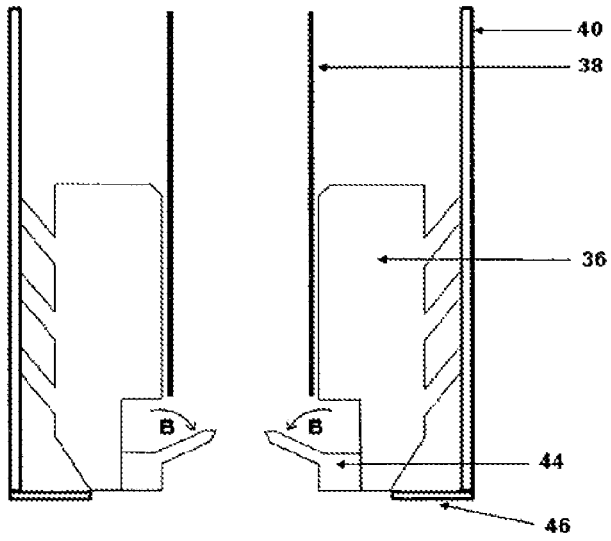

As is shown in FIGS. 6*a* and 6*b*, the upper cement plug 36 moves down the basket 40 in the direction of arrows A to fill the gap created by the deployment of a previous cement plug. In FIG. 6*a*, the protective sleeve 38 is supporting the resiliently deformable section 44. When the cement plug 36 has reached the end of the basket 40, it is stopped by the plug lock 46. The plug lock can consist of a restriction in the basket section, a spring loaded gate, or any other means that will prevent the plug from exiting the basket due to gravity and/or the friction force created by fluid flow through the cement plug.

When the cement plug has reached the bottom of the basket 40, as depicted by FIG. 6*b*, the resiliently deformable section 44 of the cement plug is no longer supported by the protective sleeve 38 and so deforms towards the inner diameter as shown by arrows B. In this position the deformable section is ready to catch a dart which may be launched down the drill pipe for the purpose of injecting a cement plug into the well casing.

Figure 7:
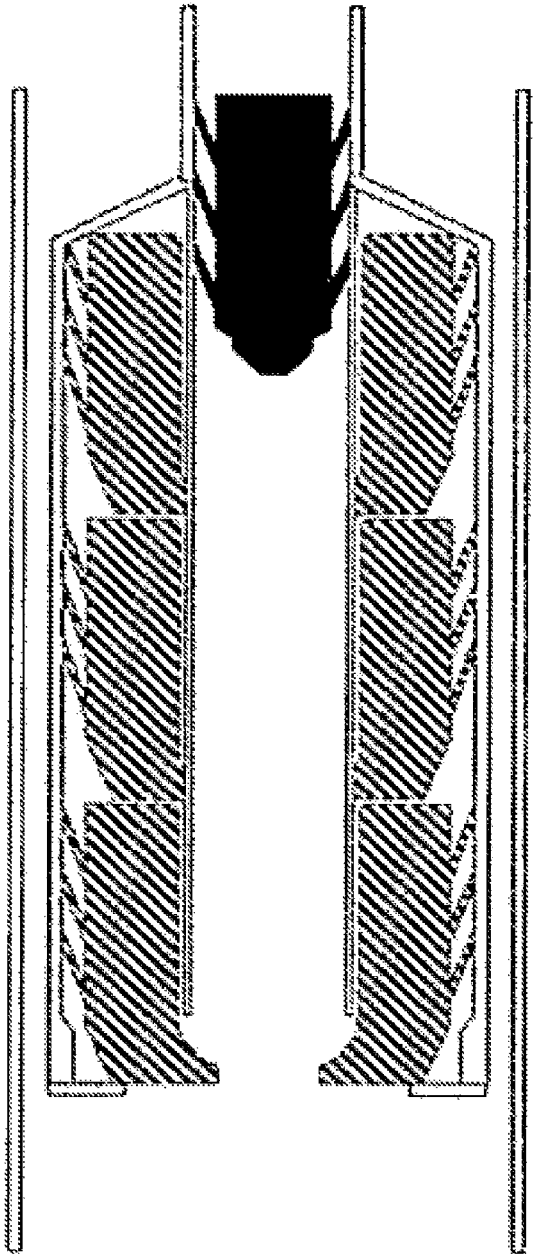
FIG. 7 shows an apparatus according to an embodiment of the invention with three cement plugs stored in the basket.

This also allows the removal of limit for the number of cement plugs to be carried in the basket. FIG. 7, for example, shows the basket carrying three cement plugs. The number of plugs in the basket makes no difference to the ability to pump darts since there is no change to the diameter of the flow passage. Also, the sleeve prevents the dart from engaging any but the lowest plug.

Figure 8:
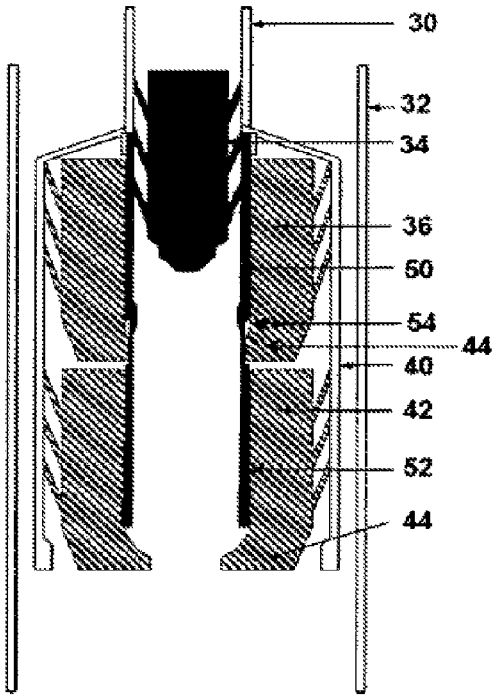
FIG. 8 shows an apparatus according to an embodiment of the invention having a protective sleeve integrated in sections into each cement plug.
Figure 9:
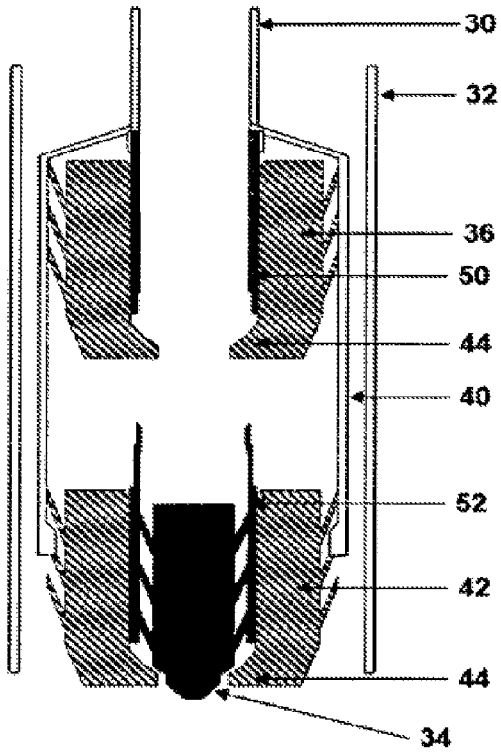
FIG. 9 shows the apparatus of FIG. 8 after deployment of a first cement plug.

In an alternative embodiment, the protective sleeve is made up of a number of sections, with each section being formed as part of a cement plug. This can be seen in FIGS. 8 and 9.

The protective sleeve section 52 of the lower cement plug 42 protects the inner diameter of the cement plug from just above the deformable area 44 and extends up beyond the upper limit of the plug. The section of protective sleeve that extends up beyond the plug can support the deformable section of the cement plug above and a shear section 54 joins the lower protective sleeve section 52 with the protective sleeve section 50 of the upper cement plug 36.

When a dart 34 is caught in the lower cement plug, the protective sleeves 50 and 52 separate at the shear point 54, and the deformable section 44 of the upper cement plug 36 is no longer supported by the protective sleeve section 52 and deforms towards the inner diameter.

Advantages of this alternative embodiment are that the cement plugs that are stored in the basket do not need to be pushed down to reach the bottom of the protective sleeve, also there is no need to have a plug lock mechanism at the bottom of the basket to prevent accidental deployment.

Figure 10:
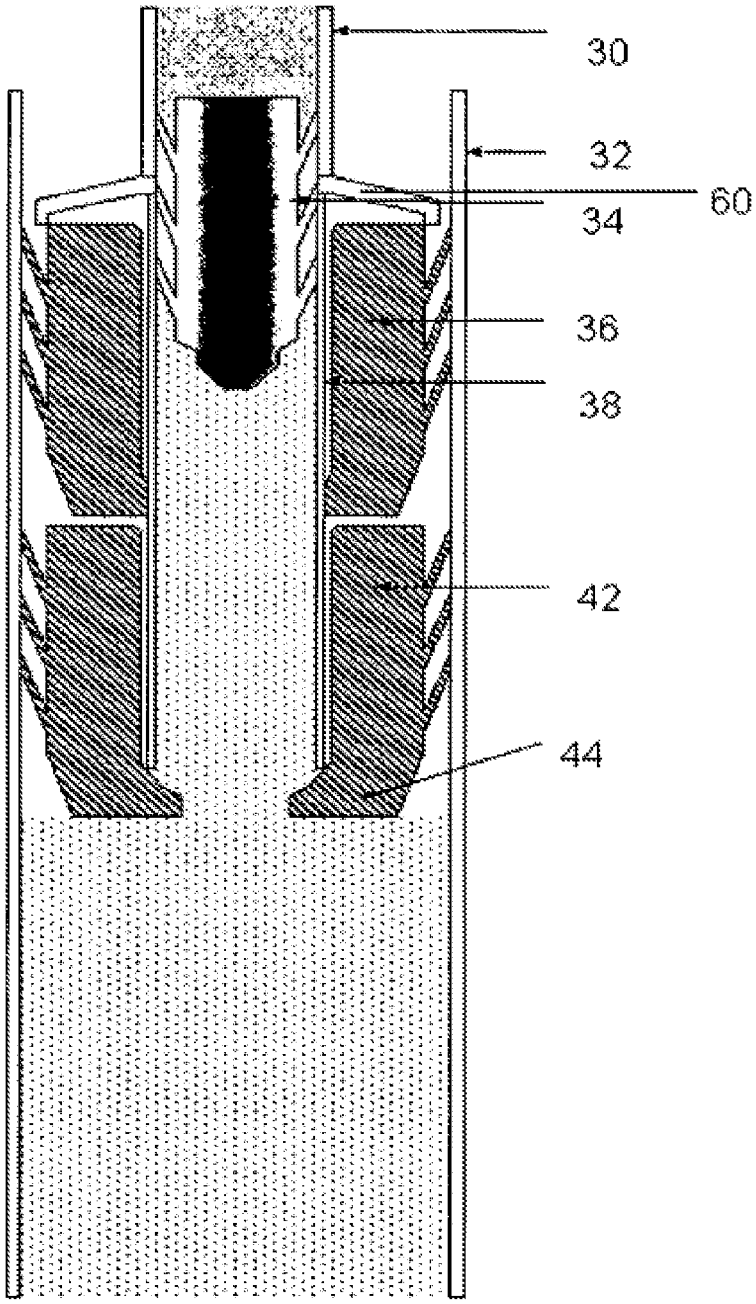
FIG. 10 shows a further embodiment of the invention.

Further changes can be made within the scope of the invention. FIG. 10 shows one embodiment of the invention demonstrating such changes. In this embodiment, no basket is present around the outside of the plugs 36, 42, which instead merely seat around the sleeve 38. A protective cap 60 is provided around the top of the sleeve 38 to prevent the plugs 36, 42 from being pushed back up the drill pipe 30 as the apparatus is run into the well. In all other respects, operation is as described above.

The invention claimed is:

1. An apparatus for installing cement plugs into a well, comprising a protective sleeve having a constant flow passage diameter and having one end adapted to be attached to the end of a drill pipe and arranged to carry more than one cementing plug retained around the outer surface of said sleeve such that formations on the plug project radially inwardly of the end of the protective sleeve such that a dart passing through the drill pipe can pass through the sleeve and engage only on formations on the plug to withdraw the plug from the end of the sleeve wherein each cementing plug has substantially the same size and dimensions.

2. The apparatus as claimed in claim 1, further comprising a tubular basket having one end adapted to be attached to the end of the drill pipe and being open at the other end, the basket defining a receptacle in which the cementing plug can be retained such that the dart passing through the drill pipe can engage on formations on the plug to withdraw the plug from the basket through the open end;

wherein the sleeve extends through the interior of the basket so as to define an annular chamber in which the cement plug can be retained such that the dart can pass through the protective sleeve and only engage the plug by means of the formations at the open end.

3. The apparatus as claimed in claim 2, wherein the basket is sized to accomodate more than one cementing plug positioned one above the other, the formations on only the lowermost extending inwards of the sleeve diameter so as to be engagable by the dart.

4. The apparatus as claimed in claim 1, wherein the protective sleeve is arranged to rupture as the lowermost cementing plug is withdrawn so that the formations of the cementing plug immediately above are allowed to project inwardly of a new end of the protective sleeve.

5. The apparatus as claimed in claim 1, wherein the protective sleeve has substantially the same internal diameter as the drill pipe.

6. The apparatus as claimed in claim 1, wherein the cementing plugs have the same diameter.

7. The apparatus as claimed in claim 1, wherein the formations on the cement plug comprise a resiliently deformable section that deforms inwardly when no longer supported in the sleeve.

8. The apparatus as claimed in claim 7, wherein the resiliently deformable section comprises at least one finger.

9. The apparatus as claimed in claim 7, wherein the resiliently deformable section comprises a shape memory material, or a pivotable member that is biased inwardly by a resilient material.

10. A method of deploying cementing plugs, comprising:

loading more than one cement plug into an apparatus comprising a protective sleeve having a constant flow passage diameter and having one end adapted to be attached to an end of a drill pipe and arranged to carry more than one cementing plug having substantially the same size and dimension and being retained around teran outer surface of said sleeve such that formations on the plug project radially inwardly of the end of the protective sleeve such that a dart passing though the drill pipe can pass through the sleeve and engage only on formations on the plug to withdraw the plug from the end of the sleeve;

connecting the apparatus to the end of the drill pipe;

positioning a casing in a well;

pumping a first dart from the surface through the drill pipe so as to pass through the protective sleeve and engage the formations on the lowermost plug and withdraw the plug from the sleeve;

allowing the next successive plug to adopt the lowermost position.

11. The method as claimed in claim 10, wherein withdrawal of the plug from the sleeve serves to also remove a portion of sleeve around which the plug is located.

12. The method of claim 10, wherein the apparatus further comprises a tubular basket having one end adapted to be attached to the end of a drill pipe and being open at the other end, the basket defining a receptacle in which a cementing plug can be retained such that a dart passing through the drill pipe can engage on formations on the plug to withdraw it from the basket through the open end;

wherein the sleeve extends through the interior of the basket so as to define an annular chamber in which the cement plug can be retained such that the dart can pass through the protective sleeve and only engage the plug by means of the formations at the open end.

13. The method of claim 12, wherein the basket is sized to accommodate more than one cementing plug positioned one above the other, the formations on only the lowermost extending inwards of the sleeve diameter so as to be engageable by a dart.

14. The method of claim 10, wherein the protective sleeve has substantially the same internal diameter as the drill pipe.

15. The method of claim 10, wherein the formations on the cement plug comprise a resiliently deformable section that deforms inwardly when no longer supported in the sleeve.

16. The method of claim 15, wherein the resiliently deformable section comprises at least one finger.

17. The method of claim 15, wherein the resiliently deformable section comprises a shape memory material, or a pivotable member that is biased inwardly by a resilient material.

18. A method of using an apparatus comprising a protective sleeve having a constant flow passage diameter and having one end adapted to be attached to the end of a drill pipe and arranged to carry more than one cementing plug having substantially the same size and dimension and being retained around the outer surface of said sleeve such that formations on the plug project radially inwardly of the end of the protective sleeve such that a dart passing through the drill pipe can pass through the sleeve and engage only on formations on the plug to withdraw the plug from the end of the sleeve; wherein said apparatus is used for launching cementing plugs.

19. The method of claim 18, wherein the apparatus is connected to the end of the drill pipe.

20. The method of claim 18, wherein the cementing plugs have the same diameter.

* * * * *